United States Patent [19]

Hinata et al.

[11] 4,028,115

[45] June 7, 1977

[54] SILVER HALIDE PHOTOGRAPHIC EMULSION SENSITIZED TO RED WITH FOUR CARBOCYANINE DYES

[75] Inventors: Masanao Hinata; Haruo Takei; Akira Sato; Atsuo Iwamoto; Jun Hayashi, all of Minami-ashigara, Japan

[73] Assignee: Fuji Photo Film Co., Ltd., Minami-ashigara, Japan

[22] Filed: Aug. 26, 1976

[21] Appl. No.: 717,837

[30] Foreign Application Priority Data

Aug. 26, 1975 Japan ..... 50-103228

[52] U.S. Cl. ..... 96/124; 96/137

[51] Int. Cl.² ..... G03C 1/14

[58] Field of Search ..... 96/124

[56] References Cited

UNITED STATES PATENTS

| | | | |
|---|---|---|---|
| 3,632,349 | 1/1972 | Shiba et al. | 96/124 |
| 3,679,428 | 7/1972 | Shiba et al. | 96/124 |
| 3,729,319 | 4/1975 | Jefferson et al. | 96/124 |

*Primary Examiner*—J. Travis Brown

*Attorney, Agent, or Firm*—Sughrue, Rothwell, Mion, Zinn & Macpeak

[57] ABSTRACT

A spectrally sensitized silver halide photographic emulsion containing, in combination, four carbocyanine sensitizing dyes.

13 Claims, 5 Drawing Figures

SILVER HALIDE PHOTOGRAPHIC EMULSION SENSITIZED TO RED WITH FOUR CARBOCYANINE DYES

BACKGROUND OF THE INVENTION

1. Field of the Invention

This invention relates to a spectrally sensitized silver halide photographic emulsion, more particularly, to a silver halide photographic emulsion suitable for preparing a red-sensitive layer of a multilayer color light-sensitive material.

2. Description of the Prior Art

Spectral sensitization is a very important procedure for extending the spectral sensitivity of a silver halide photographic emulsion to wavelengths longer than the inherent sensitivity region of the silver halide itself to yield spectral sensitivity in the green and red regions, as well as to increase the overall sensitivity (to white light). In particular, multilayer color light-sensitive materials require photographic emulsion layers respectively sensitive to blue, green and red, and spectral sensitization is, therefore, indispensable to obtain photographic emulsion layers respectively sensitive to green and red.

Moreover, for color light-sensitive materials, good color reproducibility is necessary, and also from this viewpoint, the spectral sensitivity characteristics of the green-sensitive layer and red-sensitive layer are of importance. In particular, the selection of the wavelength at which the red-sensitive layer has a sensitization maximum is of significance, since it delicately affects the reproduction of flesh tints, which is important in color photography, and also affects variations in the color balance due to light sources as is described in Japanese Patent Publication No. 6207/74. For example, it is described in Japanese Patent Publication No. 6207/74 that when about 605 nm (±5 nm) is selected for the wavelength at which the red-sensitive layer of the multilayer color light-sensitive material has a sensitization maximum, color balance is best kept with respect to three types of illumination, i.e., sunlight, a tungsten lamp and a fluorescent lighting. However, this selection of the wavelength at which the red-sensitive emulsion layer has a sensitization maximum cannot provide high sensitivity, although variations in the color balance with respect to these three types of light sources is minimized. Thus, for preparing a highly sensitive color light-sensitive material for use in photography, it is necessary to increase the size of the silver halide grains in the photographic emulsion in order to increase sensitivity, whereby graininess is encountered and sharpness is sacrificed.

It was found that in order to obtain highly sensitive color light-sensitive materials having satisfactory color reproducibility without suffering the above defects, it is most advantageous that the wavelength at which the red-sensitive layer has a sensitization maximum ranges from 625 to 645 nm, and the spectral sensitivity in the wavelength region of 580 to 600 nm is at least 40% of the maximum spectral sensitivity. There are known many sensitizing dyes which give a sensitization maximum in the above wavelength region, but the photographic emulsions using known sensitizing dyes cannot provide a sufficiently high spectral sensitivity at wavelengths of 580 to 600 nm.

In addition, since present-day multilayer color light-sensitive materials contain color image-forming couplers in the photographic emulsion layers, it is required that the spectral sensitizing effect of the sensitizing dyes not be inhibited by the presence of the couplers. Another requirement is freedom from coloring due to dye remaining after photographic processing, because such coloring remarkably deteriorates the hue of the color photograph obtained.

SUMMARY OF THE INVENTION

It is a first object of this invention to provide a silver halide photographic emulsion having high sensitivity to red light is suitable for preparing a red-sensitive layer of a highly sensitive color light-sensitive material having satisfactory color reproducibility.

It is a second object of this invention to provide a spectrally sensitized silver halide photographic emulsion in which a lowering of sensitivity brought about when a cyan color image forming coupler is present is reduced.

It is a third object of this invention to provide a spectrally sensitized silver halide photographic emulsion which can form a red-sensitive emulsion layer showing less residual color after photographic processing.

The above objects are accomplished by incorporating into a silver halide photographic emulsion spectrally sensitizing amounts of at least one sensitizing dye represented by the following general formula (I), at least one sensitizing dye represented by the following general formula (II), at least one sensitizing dye represented by the following general formula (III) and at least one sensitizing dye represented by the following general formula (IV), in combination.

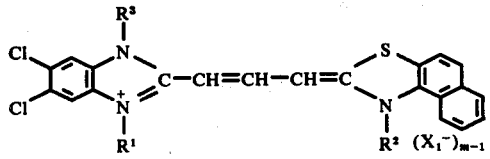

(I)

In the above formula, $R^1$ and $R^2$ each represents an alkyl group including a substituted alkyl group, $R^3$ represents an alkyl group, $X_1$ represents an acid anion and $m$ is 1 or 2, $m$ being 1 in the case that the dye forms an inner salt.

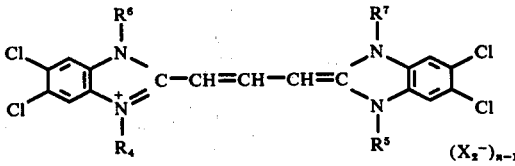

(II)

In the above formula, $R^7$ represents an alkyl group, $R^4$, $R^5$ and $R^6$ each represents an alkyl group including a substituted alkyl group, $X_2$ represents an acid anion and $n$ is 1 or 2, $n$ being 1 in the case that the dye forms an inner salt.

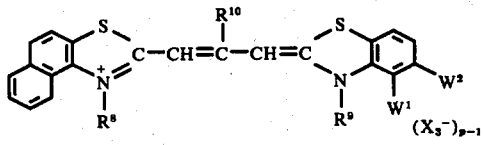

(III)

In the above formula, $R^8$ and $R^9$ each represents an alkyl group including a substituted alkyl group, $R^{10}$ represents an alkyl group, an aryl group, a furyl group or a thienyl group, $W^2$ represents a hydrogen atom, a halogen atom, an alkyl group, an alkoxy group, a hydroxy group, an alkoxycarbonyl group, an acyl group, an acylamino group or a phenyl group, $W^1$ represents a hydrogen atom or an atomic group required to form a benzene nucleus in conjunction with $W^2$, $X_3$ represents an acid anion and $p$ is 1 or 2, $p$ being 1 in the case that the dye forms an inner salt.

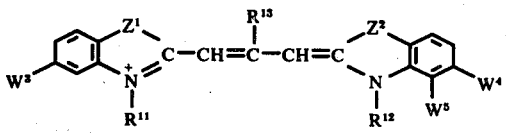

(IV)

In the above formula, $Z^1$ and $Z^2$ each represents a sulfur atom or a selenium atom, $W^3$ and $W^4$ each represents a hydrogen atom, an alkyl group, an alkoxy group, a hydroxy group, a halogen atom, a phenyl group, an acyl group, an acylamino group or an alkoxycarbonyl group, $W^4$ may form a benzene nucleus in conjunction with $W^5$ when $W^1$ and $W^2$ in general formula (III) form a benzene nucleus, $W^5$ represents a hydrogen atom or an atomic group required to form a benzene nucleus in conjunction with $W^4$, $R^{11}$ and $R^{12}$ each represents an alkyl group or a substituted alkyl group having a sulfo group, at least one of $R^{11}$ and $R^{12}$ representing a substituted alkyl group having a sulfo group, and $R^{13}$ represents an alkyl group.

Whan any dye represented by the above general formulae (I), (II), (III) or (IV) is an anionic dye, i.e., $R^1$ and $R^2$ in general formula (I), $R^4$ and $R^5$ in general formula (II), $R^8$ and $R^9$ in general formula (III) or $R^{11}$ and $R^{12}$ in general formula (IV) simultaneously represent substituents having either a carboxy group or a sulfo group, the dye contains a cation as a counter ion, for example, a hydrogen atom, an alkali metal ion such as a sodium ion, an organic base cation such as pyridine or triethylamine, etc.

In the aforesaid general formulae, the number of carbon atoms of the alkyl moiety of any substituted alkyl group or alkyl group represented by $R^1$, $R^2$, $R^3$, $R^4$, $R^5$, $R^6$, $R^7$, $R^8$, $R^9$, $R^{10}$, $R^{11}$, $R^{12}$ and $R^{13}$ is 1 to 8, preferably 1 to 4. In general formulae (III) or (IV), the number of carbon atoms of any alkyl group or alkoxy group, or any alkyl moiety of the acyl group, acylamino group or alkoxycarbonyl group represented by $W^2$, $W^3$ and $W^4$ is 1 to 8, preferably 1 to 4.

BRIEF DESCRIPTION OF THE ACCOMPANYING DRAWINGS

FIGS. 1 and 2 show the spectral sensitivity curves obtained, respectively, in Test Nos. 3 - 3 and 5 - 1 of Example 1 given in Table 1.

FIGS. 3 to 5 shown the spectral sensitivity curves obtained, respectively, in Test Nos. 1 - 4, 4 - 1 and 12 of Example 2 given in Table 2.

DETAILED DESCRIPTION OF THE INVENTION

Figure 1:
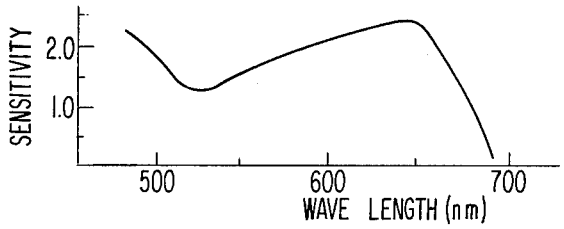

Specific examples of each substituent in general formulae (I), (II), (III) and (IV) representing the sensitizing dyes used in this invention are given below.

$R^1$ and $R^2$ each represents an alkyl group such as methyl, ethyl or propyl, or a substituted alkyl group having at least one substituent, e.g., such as hydroxy, acyloxy, carboxy, alkoxycarbonyl, sulfo, carbamoyl, halogen, sulfoalkoxy or sulfoalkoxyalkoxy group, wherein any alkyl moiety or alkoxy moiety preferably has 1 to 4 carbon atoms, such as vinylmethyl, 2-hydroxyethyl, 3-hydroxypropyl, 2-acetoxyethyl, 2-methoxyethyl, 3-methoxypropyl, carboxymethyl, 2-carboxyethyl, 3-carboxypropyl, 4-carboxybutyl, 2-methoxycarbonylethyl, 3-ethoxycarbonylpropyl, 2-sulfoethyl, 3-sulfopropyl, 3-sulfobutyl, 4-sulfobutyl, 2-carbamoylethyl, 2-N-ethylcarbamoylethyl, 2-(3-sulfopropoxy)ethyl, 2-hydroxy-3-sulfopropyl or 2-[2-(3-sulfopropoxy)ethoxy]ethyl.

Specific examples of $R^4$, $R^5$ and $R^6$ are the same as $R^1$ and $R^2$ described above.

$R^3$, $R^7$ and $R^{13}$ each represents an alkyl group such as methyl, ethyl or n-propyl.

$R^8$ and $R^9$ each represents an alkyl group such as methyl, ethyl or propyl, or a substituted alkly group as described for $R^1$ and $R^2$, such an vinylmethyl, 2-hydroxyethyl, 3-hydroxypropyl, methoxyethyl, carboxymethyl, 2-carboxyethyl, 3-carboxypropyl, 4-carboxybutyl, 2-methoxycarbonylethyl, 3-ethoxycarbonylpropyl, 3-sulfopropyl, 3-sulfobutyl or 4-sulfobutyl. $R^{11}$ and $R^{12}$ each represents an alkyl group such as methyl, ethyl or propyl, or a substituted alkyl group, for example, an alkyl group substituted with a sulfo group such as 2-sulfoethyl, 3-sulfopropyl, 3-sulfobutyl or 4-sulfobutyl, an alkyl group substituted with a sulfoalkoxy group or a sulfoalkoxyalkoxy group such as a 2-(3-sulfopropoxy)ethyl or a 2-[2-(3-sulfopropoxy)ethoxy]ethyl group, an alkyl group substituted with a hydroxy group such as 2-hydroxyethyl, 3-hydroxypropyl, 4-hydroxybutyl or 3-hydroxybutyl.

$R^{10}$ represents an alkyl group such as methyl, ethyl or propyl, an aryl group such as phenyl or phenethyl, a furyl group or a thienyl group.

$W^2$ represents a hydrogen atom, a halogen atom such as chlorine or bromine, an alkyl group such as methyl or ethyl, an alkoxy group such as methoxy or ethoxy, a hydroxy group, an alkoxycarbonyl group such as methoxycarbonyl or ethoxycarbonyl, an acyl group such as acetyl or propionyl, an acylamino group such as an acetylamino group, a phenyl group, or an atomic group required to form a benzene nucleus in conjunction with $W^1$.

Specific examples of $W^3$ and $W^4$ are the same as $W^2$.

$W^4$ may form a benzene nucleus in conjunction with $W^5$ when $W^1$ and $W^2$ together form a benzene nucleus.

Acid anions represented by $X_1$, $X_2$ and $X_3$ include acid anions used in usual cyanine dye salts, such as an iodide, bromide, chloride, p-toluenesulfonate, benzenesulfonate, sulfate, perchlorate or rhodanate ion.

The combination of dyes represented by the following formulae (I-1), (II-1), (III-1) and (IV-1) is particularly preferred in this invention.

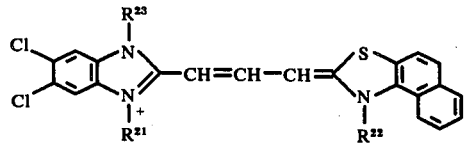

(I-1)

In this formula, $R^{21}$ and $R^{22}$ each represents a sulfoalkyl group, most preferably having from 1 to 10 carbon atoms, and $R^{23}$ represents an alkyl group, most preferably having from 1 to 4 carbon atoms.

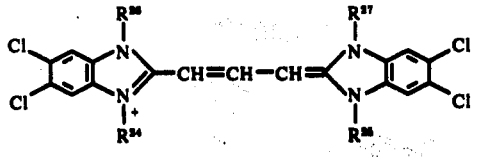

(II-1)

In this formula, $R^{24}$ and $R^{25}$ each represents a sulfoalkyl group, most preferably having from 1 to 10 carbon atoms, or a sulfoalkoxyalkyl group, most preferably having from 1 to 10 carbon atoms, and $R^{26}$ and $R^{27}$ each represents an alkyl group, most preferably having from 1 to 4 carbon atoms.

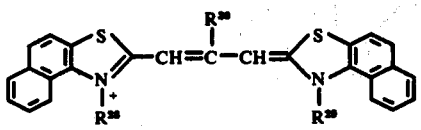

(III-1)

In this formula, $R^{28}$ and $R^{29}$ each represents a sulfoalkyl group, most preferably having from 1 to 10 carbon atoms, and $R^{30}$ represents a methyl group or an ethyl group.

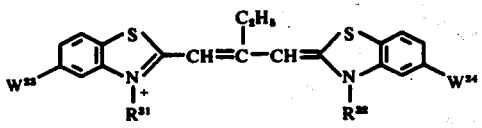

(IV-1)

In this formula, $W^{23}$ and $W^{24}$ each represents a hydrogen atom, a chlorine atom, an alkyl group having 1 to 4 carbon atoms, an alkoxy group having 1 to 4 carbon atoms or a hydroxy group, and $R^{31}$ and $R^{32}$ each represents a sulfoalkyl group, most preferably having from 1 to 10 carbon atoms.

Illustrative examples of the sensitizing dyes used in this invention are given below, which are not limitative.

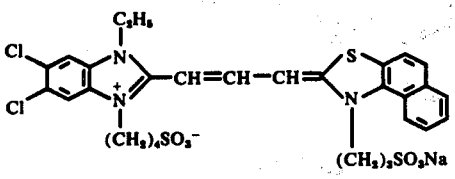

(I-A)

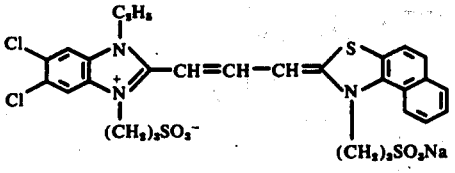

(I-B)

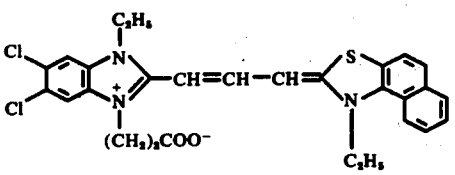

(I-C)

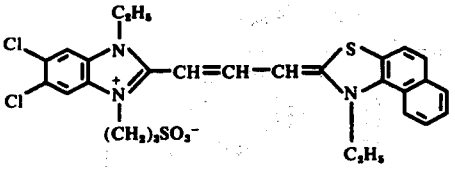

(I-D)

-continued

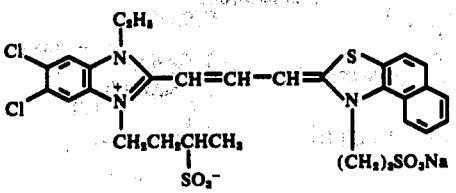

(I-E)

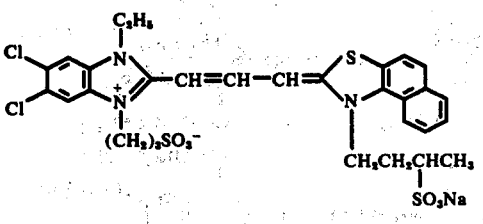

(I-F)

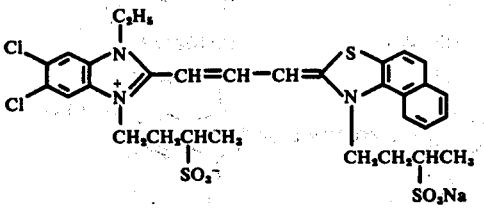

(I-G)

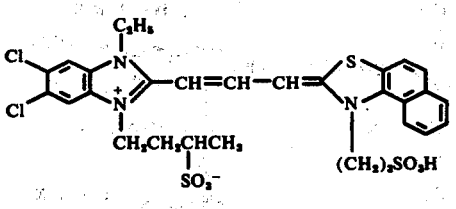

(I-H)

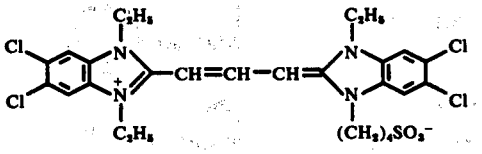

(II-A)

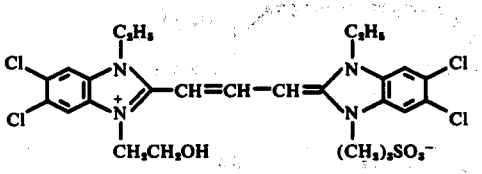

(II-B)

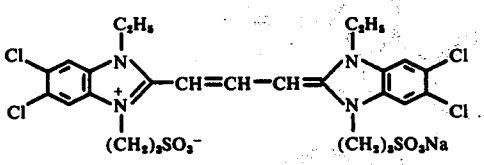

(II-C)

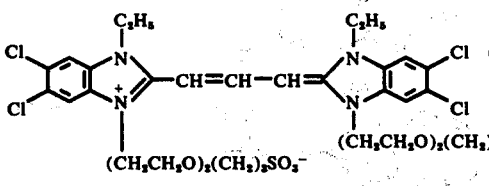

(II-D)

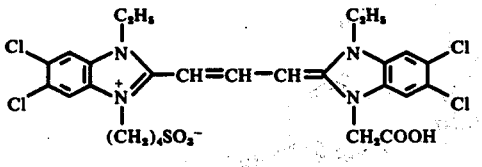

(II-E)

-continued
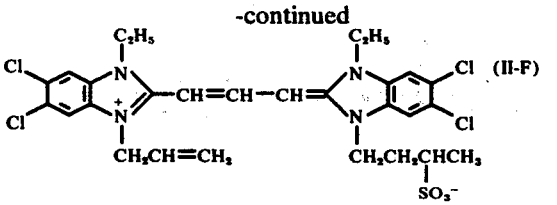
(II-F)
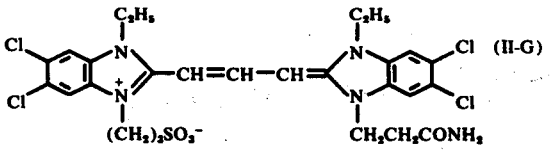
(II-G)
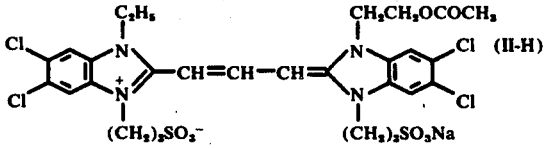
(II-H)
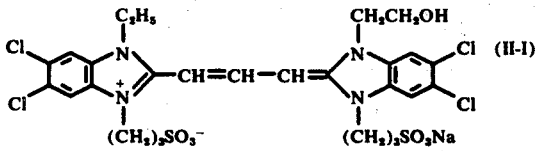
(II-I)
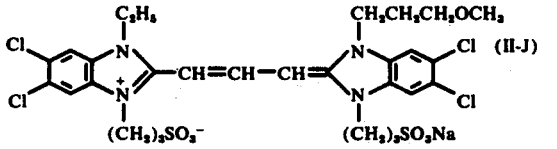
(II-J)
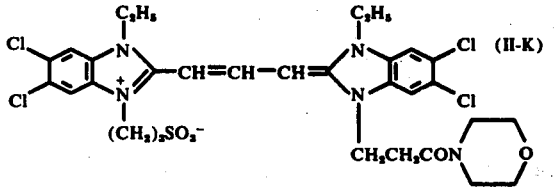
(II-K)
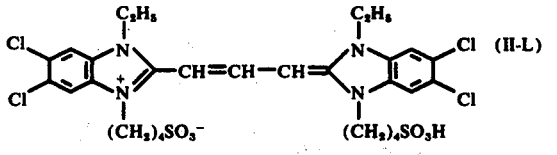
(II-L)
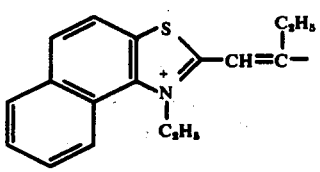
(III-A)
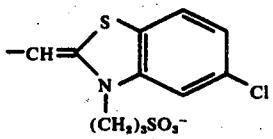
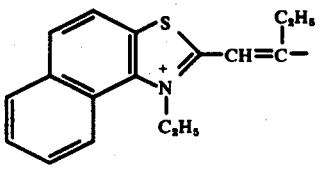
(III-B)
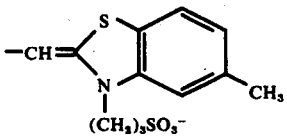
-continued
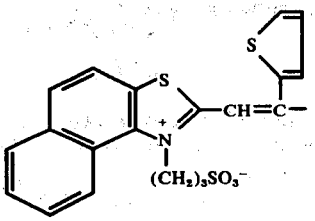
(III-C)
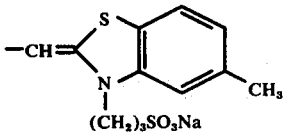
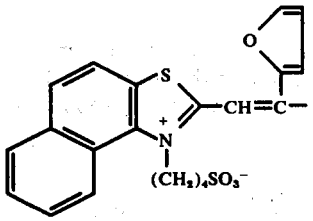
(III-D)
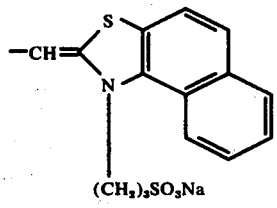
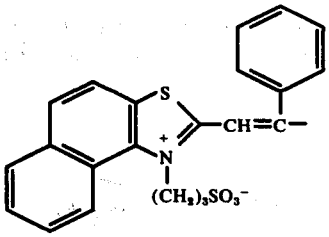
(III-E)
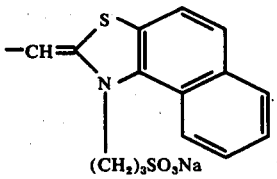
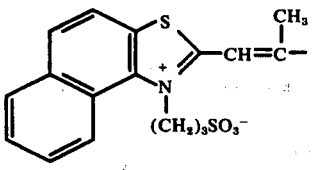
(III-F)
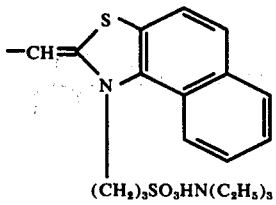

-continued
(III-G)
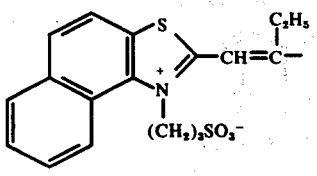
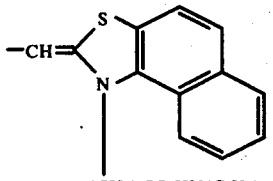
(III-H)
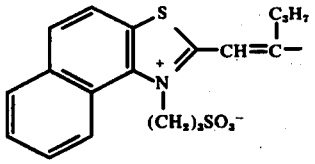
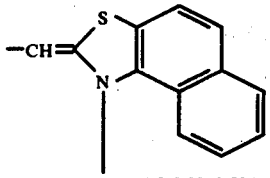
(III-I)
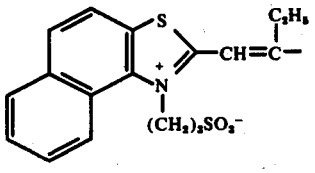
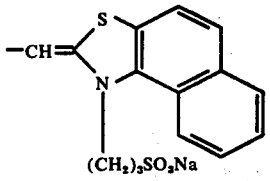
(III-J)
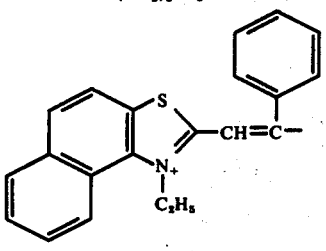
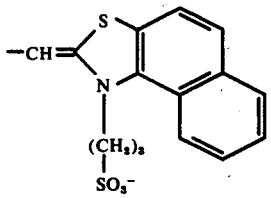
(III-K)
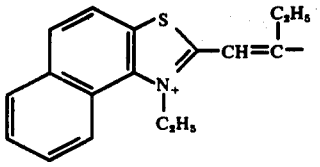
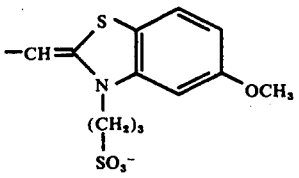
(IV-A)
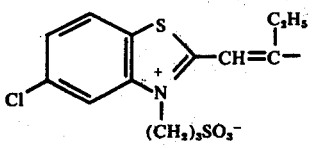
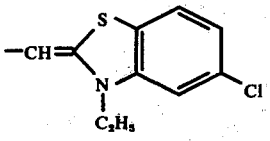
(IV-B)
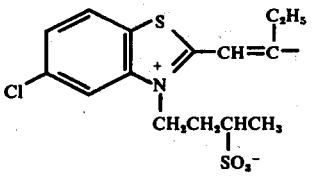
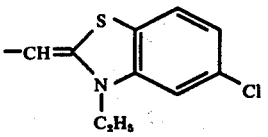
(IV-C)
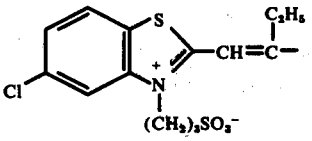
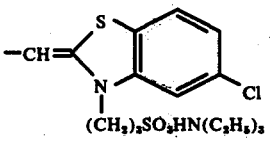
(IV-D)
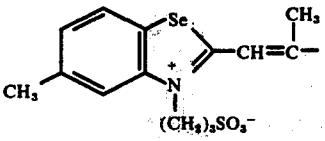
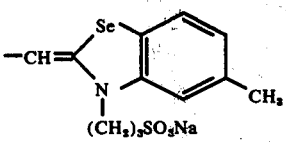
(IV-E)
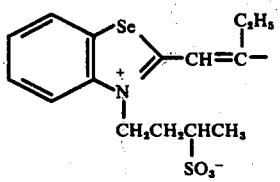
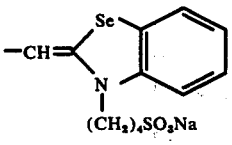
(IV-F)
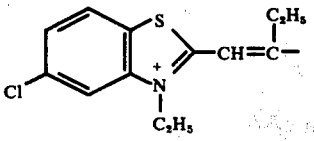

-continued
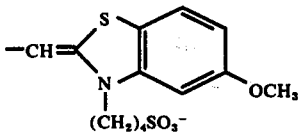
(IV-G)
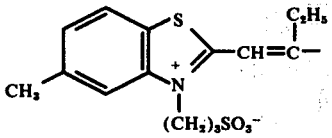
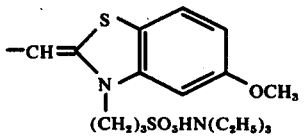
(IV-H)
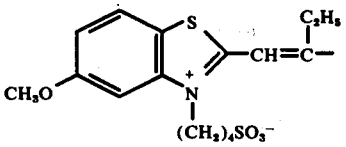
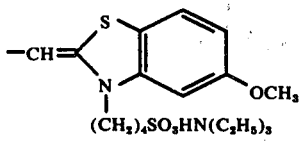
(IV-I)
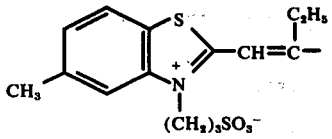
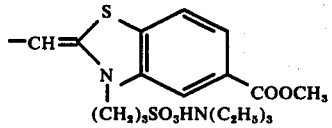
(IV-J)
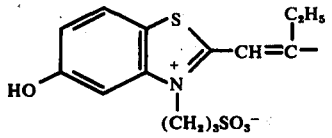
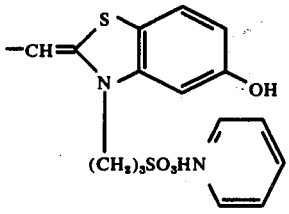
(IV-K)
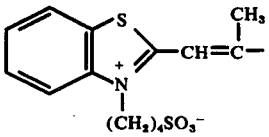
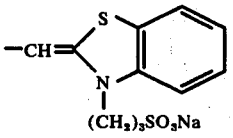
(IV-L)
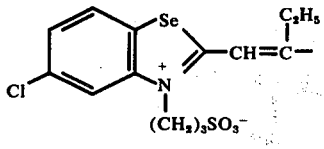
-continued
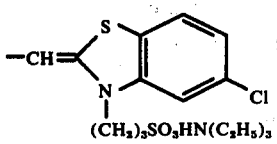
(IV-M)
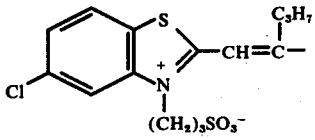
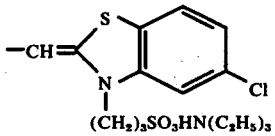
(IV-N)
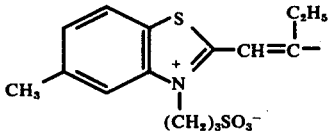
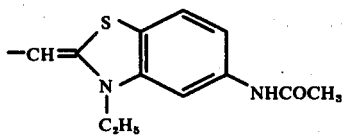
(IV-O)
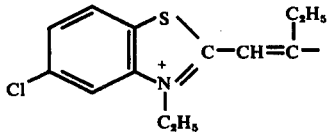
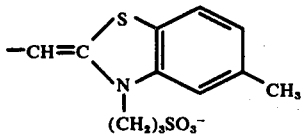
(IV-P)
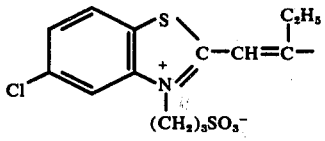
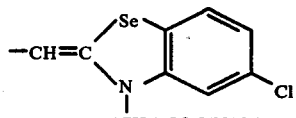
(IV-Q)
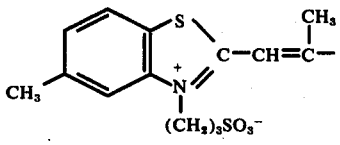
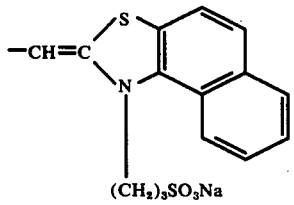
(IV-R)
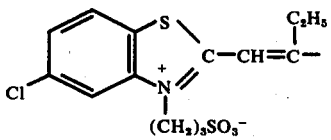

-continued

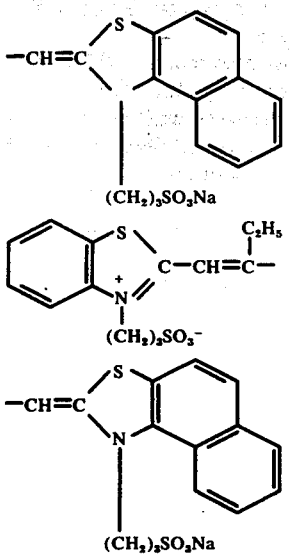

(IV-S)

The compounds represented by general formulae (I), (II), (III) and (IV) are incorporated in the silver halide photographic emulsion in an amount of $1 \times 10^{-6}$ mol–5 $\times 10^{-3}$ mol, preferably $5 \times 10^{-6}$ mol–$5 \times 10^{-4}$ mol, particularly $1 \times 10^{-5}$–$3 \times 10^{-4}$ mol, per mol of silver halide. The ratio of the amounts used of the sensitizing dyes represented by general formulae (I), (II), (III) and (IV) is of significance for the achievement of the objects of this invention. The dye of general formula (I), the dye of general formula (II), the dye of general formula (III), and the dye of general formula (IV) must be used in a molar ratio of 1–20 of (I) : 1–20 of (II) : 1 of (III) : 4–40 of (IV), preferably 1–10 of (I) : 1–10 of (II) : 1 of (III) : 6–30 of (IV).

When, in general formula (III), $R^{10}$ represents a methyl group, ethyl group or propyl group, and $W^1$ and $W^2$ form a benzene nucleus, the dye of general formula (I), the dye of general formula (II), the dye of general formula (III) and the dye of general formula (IV) may be used in a molar ratio of 2.0–6.0: 1.5–6.0:1:6.0–20.0. In such case, the dye of general formula (III) may be used in an amount ranging from $0.2 \times 10^{-5}$ mol to $2.4 \times 10^{-5}$ mol per mol of silver halide.

When, in general formula (III), $R^{10}$ represents a phenyl group, and $W^1$ and $W^2$ form a benzene nucleus, the dye of general formula (I), the dye of general formula (II), the dye of general formula (III) and the dye of general formula (IV) may be used in a molar ratio of 4.0–10.0:3.0–10.0:1:10.0–30.0. In such case, the dye of general formula (III) may be used in an amount ranging from $0.05 \times 10^{-5}$ mol to $2.4 \times 10^{-5}$ mol per mol of silver halide.

The silver halide photographic emulsion used in this invention is prepared by conventional methods. It can contain grains of silver chloride, silver bromide, silver iodide or mixed silver halides precipitated, for example, by the single jet method or the double jet method or by using a combination thereof, and thereafter ripened. Preferred silver halides are silver bromoiodide, and siliver chlorobromoiodide; most preferably such silver halides contain no more than about 10 mol% silver iodide. Silver bromoiodide is most preferred. The silver halide may be either of finely divided particles or of course particles, but the average diameter of the grains (e.g., as measured by the projected area method in number average) is preferably 0.04 to 4 $\mu$.

The silver halide photographic emulsion used in this invention can be subjected to usual chemical sensitizing methods such as gold sensitization (as described in U.S. Pat. Nos. 2,399,083, 2,540,085, 2,597,856 and 2,597,915), sensitization using Group VIII metal ions (as described in U.S. Pat. Nos. 2,448,060 and 2,598,079), sulfur sensitization (as described in U.S. Pat. Nos. 1,574,944 and 2,410,689), reduction sensitization (as described in U.S. Pat. Nos. 2,518,698, 2,419,974 and 2,983,610) or various combined sensitizing methods thereof.

The finished emulsion is then generally coated on a suitable support. Various supports can be used for coating the photographic emulsion of this invention thereon to form a photosensitive element. Typical supports include cellulose aliphatic-acid ester films such as cellulose acetate, polystyrene, polyester films such as polyethylene terephthalate, paper, metals, glass, ceramics, etc. Paper laminated with an $\alpha$-olefin polymer such as polyethylene, an ethylene-butene copolymer or the like is also useful. Examples of other materials include baryta paper, other resin-coated papers, synthetic papers, triacetate film, etc.

The sensitizing dyes used in this invention are added to a silver halide emulsion as an aqueous solution or a solution thereof dissolved in a water miscible organic solvent such as methanol, ethanol, methyl cellosolve, dimethylformamide or pyridine. The sensitizing dyes may be dissolved by means of ultrasonic vibration as described in U.S. Pat. No. 3,485,634. Other methods of dissolving or dispersing the sensitizing dyes in the emulsion can also be used, as are described in U.S. Pat. Nos. 3,482,981, 3,585,195, 3,469,987, 3,425,835 and 3,342,605, British Pat. Nos. 1,271,329, 1,038,029 and 1,121,174, and U.S. Pat. Nos. 3,660,101 and 3,658,546. Moreover, the method described in German Patent Application (OLS) No. 2,104,283 and the method described in U.S. Pat. No. 3,649,286 can be used.

The dyes of formula (I) can be prepared in accordance with the teaching of British Pat. No. 1,138,395, the dyes of formula (II) in accordance with U.S. Pat. No. 2,739,149, the dyes of formula (III) in accordance with U.S. Pat. No. 3,177,210 and the dyes of formula (IV) in accordance with U.S. Pat. No. 2,503,776.

The silver halide photographic emulsion of this invention can contain color couplers and a dispersing agent therefor.

Of the color couplers, cyan couplers are particularly preferred. For example, phenol couplers are described in U.S. Pat. No. 2,698,794 and naphthol couplers as described in U.S. Pat. No. 2,474,293 are particularly useful.

Moreover, couplers are described in U.S. Pat. No. 2,600,788, British Pat. No. 904,852 and Japanese Patent Publication No. 6031/65, and cyan couplers of the $\alpha$-naphthol type and cyan couplers of the phenol type, for example, compounds as described in U.S. Pat. Nos. 3,311,476, 3,458,315, 3,215,437 and 3,253,924, can be used.

Typical examples of useful colored couplers are those as described in U.S. Pat. Nos. 3,034,982, 3,386,301 and 2,434,272.

Typical DIR couplers useful are, for example, those as described in U.S. Pat. Nos. 3,148,062, 3,227,554, 3,701,783, 3,617,291 and 3,622,328, Japanese Patent Publication No. 28836/70, Japanese Patent Application No. 33238/73 and German Patent Application (OLS) No. 2,163,811.

The following Examples further illustrate this invention but are not intended to limit it.

EXAMPLE 1

A silver bromoiodide emulsion (having an iodide content of 8.5 mol%) was prepared by forming silver halide grains by the single jet method and subjecting the same to physical ripening, desalting and chemical ripening by conventional methods. The average diameter of the silver halide grains contained in this emulsion was 1.3 microns. This emulsion contained 0.74 mol of the silver halide and 60 g of gelatin per 1 kg of the emulsion.

1 kg of this emulsion was placed in a container and dissolved in a constant temperature bath at 50° C. Methanol solutions of sensitizing dyes of this invention were respectively added in the amounts shown in Table 1 below, and mixing was effected at 40° C with stirring. 10 ml of a 1 wt% aqueous solution of 4-hydroxy-6-methyl-1,3,3a,7-tetrazaindene, 10 ml of 1 wt% aqueous solution of 1-hydroxy-3,5-dichlorotriazine sodium salt and 10 ml of 1 wt% aqueous solution of sodium dodecylbenzenesulfonate were successively added followed by stirring. The finished emulsion was coated on a cellulose triacetate film base so as to provide a layer thickness of 5 microns on a dry basis and then dried, thus obtaining a sample of a light-sensitive material. The film sample was cut into strips. One of the strips was subjected to optical wedge exposure using a sensitometer with a light source of a color temperature of 5400° K, a red filter (Fuji SC-56 filter) or a blue filter (Fuji SP-1 filter) made by Fuji Photo Film Co., Ltd., being attached to the light source. The other was exposed to obtain a spectrogram using a diffraction grating type spectrograph.

The strips were developed at 20° C for 2 minutes using a developer having the following composition, stopped, fixed and washed with water to obtain strips having a certain black and white image. The strips were then subjected to density measurement using a P-type densitometer made by Fuji Photo Film Co., Ltd. to obtain red light sensitivity (SR), blue light sensitivity (SB) and fog values. The standard point of the optical density to determine sensitivity was (fog + 0.20).

| Developer | | |
|---|---|---|
| water | 500 | ml |
| monomethylparaaminophenol semi-sulfate | 2.2 | g |
| sodium sulfite | 96.0 | g |
| hydroquinone | 8.8 | g |
| sodium carbonate (monohydrate) | 56.0 | g |
| potassium bromide | 5.0 | g |
| water to make | 1 | l |

The results obtained are shown in Table 1 as relative values.

TABLE 1

| Test No. | Sensitizing Dye* and Amount (× $10^{-5}$ mol) | | | | | | | | SR | SB | Fog |
|---|---|---|---|---|---|---|---|---|---|---|---|
| 1-1 | — | | — | | — | | — | | — | 100 | 0.05 |
| 2 | (I-A) | 2.0 | (II-D) | 2.0 | (III-F) | 0.6 | (IV-C) | 8.0 | 348 | 92 | 0.05 |
| 3 | | 2.0 | | 2.0 | | 1.2 | | 8.0 | 348 | 83 | 0.05 |
| 2-1 | (I-D) | 2.0 | (II-C) | 2.0 | (III-B) | 0.6 | (IV-C) | 8.0 | 292 | 86 | 0.05 |
| 2 | | 2.0 | | 2.0 | | 1.2 | | 8.0 | 296 | 83 | 0.05 |
| 3-1 | (I-A) | 2.0 | (II-D) | 2.0 | (III-G) | 0.6 | (IV-C) | 4.0 | 282 | 89 | 0.05 |
| 2 | | 2.0 | | 2.0 | | 0.6 | | 6.0 | 292 | 86 | 0.05 |
| 3 | | 2.0 | | 2.0 | | 0.6 | | 8.0 | 305 | 83 | 0.05 |
| 4 | | 2.0 | | 2.0 | | 0.6 | | 10.0 | 300 | 79 | 0.06 |
| 5 | | 2.0 | | 2.0 | | 0.6 | | 12.0 | 282 | 75 | 0.06 |
| 4 | (I-G) | 2.0 | (II-C) | 2.0 | (III-G) | 0.6 | (IV-C) | 8.0 | 307 | 86 | 0.05 |
| 5-1 | (I-G) | 2.0 | (II-C) | 2.0 | (III-F) | 0.6 | (IV-C) | 8.0 | 338 | 92 | 0.05 |
| 2 | | 2.0 | | 2.0 | | 1.2 | | 8.0 | 348 | 92 | 0.05 |
| 6 | (I-D) | 2.0 | (II-C) | 2.0 | (III-F) | 1.2 | (IV-C) | 8.0 | 320 | 83 | 0.05 |
| 7-1 | (I-G) | 2.0 | (II-G) | 2.0 | (III-E) | 0.3 | (IV-N) | 6.0 | 316 | 92 | 0.05 |
| 2 | | 2.0 | | 2.0 | | 0.6 | | 6.0 | 325 | 92 | 0.05 |
| 3 | | 2.0 | | 2.0 | | 1.2 | | 6.0 | 338 | 88 | 0.05 |
| 8-1 | (I-G) | 2.0 | (II-G) | 2.0 | (III-A) | 0.6 | (IV-D) | 4.0 | 296 | 90 | 0.05 |
| 2 | | 2.0 | | 2.0 | | 0.6 | | 6.0 | 307 | 86 | 0.05 |
| 3 | | 2.0 | | 2.0 | | 0.6 | | 8.0 | 288 | 82 | 0.05 |
| 9-1 | (I-G) | 2.0 | (II-G) | 2.0 | (III-G) | 0.6 | (IV-E) | 4.0 | 297 | 96 | 0.05 |
| 2 | | 2.0 | | 2.0 | | 0.6 | | 6.0 | 307 | 92 | 0.05 |
| 3 | | 2.0 | | 2.0 | | 0.6 | | 8.0 | 307 | 92 | 0.05 |
| 4 | | 2.0 | | 2.0 | | 0.6 | | 10.0 | 290 | 83 | 0.06 |
| 10-1 | (I-D) | 2.0 | (II-C) | 2.0 | (III-J) | 0.3 | (IV-Q) | 4.0 | 316 | 96 | 0.05 |
| 2 | | 2.0 | | 2.0 | | 0.6 | | 4.0 | 320 | 82 | 0.05 |
| 11-1 | (I-D) | 2.0 | (II-C) | 2.0 | (III-D) | 0.2 | (IV-R) | 3.0 | 296 | 87 | 0.05 |
| 2 | | 2.0 | | 2.0 | | 0.4 | | 3.0 | 302 | 82 | 0.05 |
| 12-1 | (I-B) | 8.0 | — | | — | | (IV-C) | 1.0 | 217 | 83 | 0.05 |
| 2 | | 8.0 | — | | — | | | 2.0 | 237 | 83 | 0.05 |
| 3 | | 8.0 | — | | — | | | 4.0 | 237 | 75 | 0.05 |
| 13-1 | — | | — | | (III-C) | 0.3 | (IV-C) | 8.0 | 208 | 92 | 0.05 |
| 2 | — | | — | | | 0.6 | | 8.0 | 217 | 86 | 0.05 |
| 3 | — | | — | | | 1.2 | | 8.0 | 199 | 73 | 0.05 |
| 14-1 | (I-A) | 2.0 | (II-D) | 2.0 | (III-G) | 0.6 | (A, for comparison | 6.0 | 208 | 76 | 0.05 |
| 2 | | 2.0 | | 2.0 | | 0.6 | | 8.0 | 224 | 76 | 0.05 |
| 3 | | 2.0 | | 2.0 | | 0.6 | | 10.0 | 217 | 70 | 0.06 |

*As earlier identified; hereafter the same.

Figure 2:
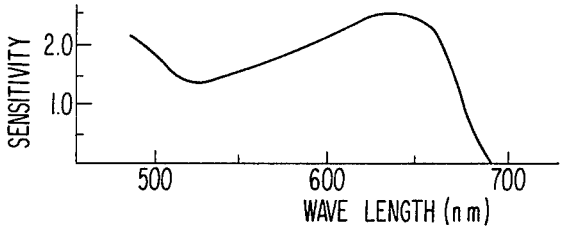

Spectral sensitivity curves respectively obtained from the results of No. 3 - 3 and No. 5 - 1 in Table 1 are shown in FIGS. 1 and 2. Test No. 12 is the case where a combination of dyes which is within the scope of U.S. Pat. No. 3,679,428 is used, and Test No. 13 is the case where a combination of dyes which is within the scope of U.S. Pat. No. 3,632,349 is used. It will be understood that the combination of the dyes of this invention shows higher sensitivity and is superior to the other ones.

EXAMPLE 2

80 g of 1-hydroxy-N-[γ-(2,4-di-tert-amylphenoxypropyl)]-2-naphthamide was completely dissolved in a mixed solution of 100 ml of tricresyl phosphate and 50 ml of ethyl acetate. Further, 2 g of sorbitan monolaurate was dissolved therein. The resulting solution was added to 1 kg of 10 wt% aqueous solution of gelatin to which 2.5 g of dodecylbenzenesulfonic acid had been added as an aqueous solution, followed by high speed stirring and then ultrasonic stirring to obtain an emulsified product.

1 kg of the silver bromoiodide emulsion prepared in the same manner as in Example 1 was placed in a container, and then dissolved in a constant temperature bath at 50° C. Methanol solutions of sensitizing dyes of this invention and methanol solutions of sensitizing dyes for comparison were respectively added in predetermined amounts to the emulsion, which was then mixed with stirring at 40° C and allowed to stand for 15 minutes. The solution of the above emulsified product (300 g) which was dissolved was added thereto, and, further, 10 ml of a 1 wt% aqueous solution of 4-hydroxy-6-methyl-1,3,3a,7-tetrazaindene, 10 ml of 1 wt% aqueous solution of 1-hydroxy-3,5-dichlorotriazine sodium salt and 10 ml of 1 wt% aqueous solution of sodium dodecylbenzenesulfonate were successively added followed by stirring.

The finished emulsion was coated on a cellulose triacetate film base so as to provide a layer thickness of 5 microns on a dry basis, and, further, a protective layer mainly comprising gelatin was coated thereon so as to provide a layer thickness of 1 micron on a dry basis and then dried to obtain a sample of a light-sensitive material.

The film sample was cut into strips. A set of the strips was subjected to optical wedge exposure using a sensitometer with a light source of a color temperature of 5400° K, a red filter (Fuji SC-56 filter) being attached to the sensitometer. The exposure condition was set to an illumination intensity of 256 lux and an exposure time of 1/20 second. Moreover, in order to examine the stability of the light-sensitive material with the passage of time after production, a set of the strips was allowed to stand for 3 days at 50° C and a relative humidity of 70%, and another set of the strips was allowed to stand for 40 days at 20° to 25° C and a relative humidity of 60 to 70%. As a result of these tests, little change was observed. Another set of the samples was exposed to obtain a spectrogram using a diffraction grating type spectrograph.

The above strips were developed at 38° C according to the following color negative development procedure.

| | | |
|---|---|---|
| 1. | Color Development | 3 min and 15 sec |
| 2. | Bleaching | 6 min and 30 sec |
| 3. | Washing | 3 min and 15 sec |
| 4. | Fixing | 6 min and 30 sec |
| 5. | Washing | 3 min and 15 sec |
| 6. | Stabilizing | 3 min and 15 sec |

The processing solutions used for the above steps had the following compositions.

| | | |
|---|---|---|
| Color Developer | | |
| sodium nitrilotriacetate | 1.0 | g |
| sodium sulfite | 4.0 | g |
| sodium carbonate | 30.0 | g |
| potassium bromide | 1.4 | g |
| hydroxylamine sulfate | 2.4 | g |
| 4-(N-ethyl-N-β-hydroxyethylamino)-2-methylaniline sulfate | 4.5 | g |
| water to make | 1 | l |
| Bleaching Solution | | |
| ammonium bromide | 160.0 | g |
| aqueous ammonia (25 wt%) | 25.0 | ml |
| sodium ethylenediaminetetraacetate iron salt | 130.0 | g |
| glacial acetic acid | 14.0 | ml |
| water to make | 1 | l |
| Fixing Solution | | |
| sodium tetrapolyphosphate | 2.0 | g |
| sodium sulfite | 4.0 | g |
| ammonium thiosulfate (70 wt%) | 175.0 | ml |
| sodium bisulfite | 4.6 | g |
| water to make | 1 | l |
| Stabilizing Solution | | |
| formalin | 8.0 | ml |
| water to make | 1 | l |

The resulting strips were subjected to measurement using a P-type densitometer made by Fuji Photo Film Co., Ltd. to obtain relative sensitivity and cyan color forming fog values. The standard point of the optical density to determine the sensitivity was (fog + 0.20). The results obtained are shown in Table 2 as relative values.

TABLE 2

| Test No. | Sensitizing Dye and Amount (× $10^{-5}$ mol) | | | | | | | | SR | Cyan Fog |
|---|---|---|---|---|---|---|---|---|---|---|
| 1-1 | — | | — | | — | | — | | — | 0.07 |
| 2 | (I-B) | 2.0 | (II-C) | 2.0 | (III-G) | 0.6 | (IV-C) | 6.0 | 169 | 0.07 |
| 3 | | 2.0 | | 2.0 | | 0.6 | | 8.0 | 172 | 0.07 |
| 4 | | 2.0 | | 2.0 | | 0.6 | | 10.0 | 172 | 0.08 |
| 2 | (I-B) | 2.0 | (II-D) | 2.0 | (III-G) | 0.6 | (IV-C) | 8.0 | 176 | 0.07 |
| 3 | (I-B) | 2.0 | (II-G) | 2.0 | (III-G) | 0.6 | (IV-C) | 8.0 | 169 | 0.07 |
| 4-1 | (I-G) | 2.0 | (II-C) | 2.0 | (III-E) | 0.3 | (IV-A) | 8.0 | 200 | 0.07 |
| 2 | | 2.0 | | 2.0 | | 0.6 | | 8.0 | 207 | 0.07 |
| 3 | | 2.0 | | 2.0 | | 1.2 | | 8.0 | 207 | 0.07 |
| 5-1 | (I-G) | 2.0 | (II-F) | 2.0 | (III-F) | 0.6 | (IV-G) | 6.0 | 203 | 0.07 |
| 2 | | 2.0 | | 2.0 | | 1.2 | | 6.0 | 210 | 0.07 |
| 6-1 | (I-G) | 2.0 | (II-A) | 2.0 | (III-C) | 0.1 | (IV-G) | 6.0 | 176 | 0.07 |
| 2 | | 2.0 | | 2.0 | | 0.3 | | 6.0 | 179 | 0.07 |
| 3 | | 2.0 | | 2.0 | | 0.6 | | 6.0 | 168 | 0.07 |
| 7-1 | (I-F) | 2.0 | (II-A) | 2.0 | (III-H) | 0.3 | (IV-E) | 6.0 | 176 | 0.07 |
| 2 | | 2.0 | | 2.0 | | 0.6 | | 6.0 | 181 | 0.07 |
| 8-1 | (I-F) | 2.0 | (II-I) | 2.0 | (III-F) | 0.6 | (IV-D) | 6.0 | 200 | 0.07 |
| 2 | | 2.0 | | 2.0 | | 1.2 | | 6.0 | 210 | 0.07 |
| 9-1 | (I-A) | 2.0 | (II-C) | 2.0 | (III-D) | 0.3 | (IV-M) | 8.0 | 172 | 0.07 |
| 2 | | 2.0 | | 2.0 | | 0.6 | | 8.0 | 167 | 0.07 |
| 10 | (I-A) | 2.0 | (II-C) | 2.0 | (III-D) | 0.3 | (IV-F) | 8.0 | 167 | 0.07 |
| 11-1 | (I-H) | 2.0 | (II-L) | 2.0 | (III-I) | 0.6 | (A, for comparison) | 6.0 | 127 | 0.07 |
| 2 | | 2.0 | | 2.0 | | 0.6 | | 8.0 | 135 | 0.07 |

TABLE 2-continued

| Test No. | Sensitizing Dye and Amount (× $10^{-5}$ mol) | | | | | | | | SR | Cyan Fog |
|---|---|---|---|---|---|---|---|---|---|---|
| 3 | | 2.0 | | 2.0 | | 0.6 | | 10.0 | 127 | 0.08 |
| 12 | (I-H) | 11.4 | (II-L) | 7.2 | (III-1) | 2.5 | (A, for comparison | | 100 | 0.08 |
| | | | | | | | | | 2.4 | |

In the above table, "SR" means the relative sensitivity when the sensitivity obtained in Test No. 12 is taken as 100.

Figure 3:
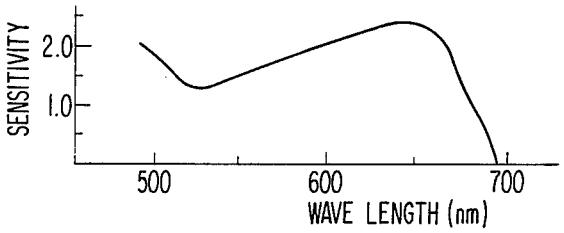
Figure 4:
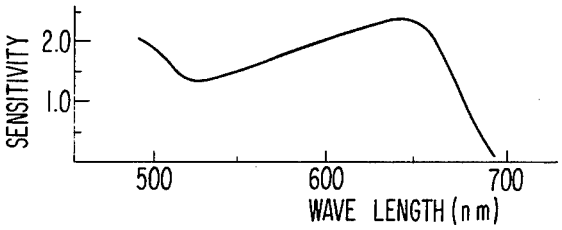
Figure 5:
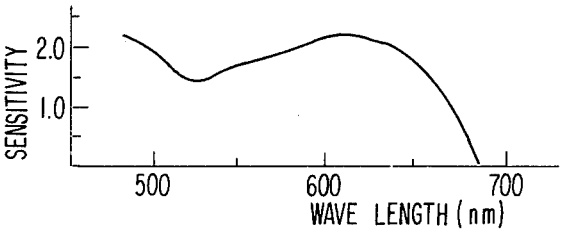

Test No. 12 is the case where a combination of dyes which is disclosed in Japanese Patent Publication No. 6207/74 is used, and Test No. 11 is the case where the same combination of dyes as in Test No. 12 is used, but the relative amounts of the dyes used are changed. Spectral sensitivity curves respectively obtained in Test Nos. 1 - 4, 4 - 1 and 12 given in the above table are shown in FIGS. 3, 4 and 5.

Dye used for comparison

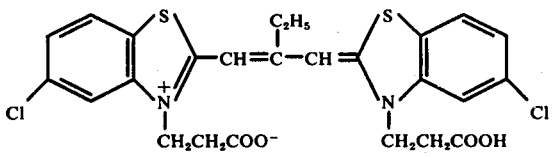

(A)

EXAMPLE 3

On the red-sensitive emulsion layer (4 $\mu$ thickness) of Example 2, an intermediate layer (1 $\mu$ thickness), a green-sensitive emulsion layer (4 $\mu$ thickness), a yellow filter layer (2 $\mu$ thickness), a blue-sensitive emulsion layer (4 $\mu$ thickness), and a gelatin protective layer (1 $\mu$ thickness) were successively coated to prepare a multilayer color photographic light-sensitive material. Exposure and development were performed in the same manner as in Example 2. Satisfactory results were obtained.

While the invention has been described in detail and with reference to specific embodiments thereof, it will be apparent to one skilled in the art that various changes and modifications can be made therein without departing from the spirit and scope thereof.

What is claimed is:

1. A spectrally sensitized silver halide photographic emulsion containing, in combination, at least one sensitizing dye represented by the following general formula (I), at least one sensitizing dye represented by the following general formula (II), at least one sensitizing dye represented by the following general formula (III) and at least one sensitizing dye represented by the following general formula (IV):

general formula (I)

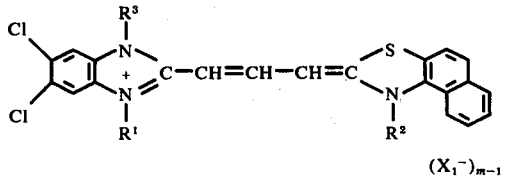

in which $R^1$ and $R^2$ each represents an alkyl group $R^3$ represents an alkyl group, $X_1$ represents an acid anion, and $m$ is 1 or 2, $m$ being 1 in the case that the dye forms an inner salt (betaine-like structure);

general formula (II)

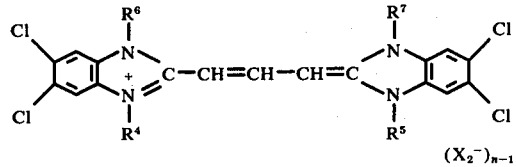

in which $R^7$ represents an alkyl group, $R^4$, $R^5$ and $R^6$ each represents an alkyl group, $X_2$ represents an acid anion, and $n$ is 1 or 2, $n$ being 1 in the case that the dye forms an inner salt (betaine-like structure);

general formula (III)

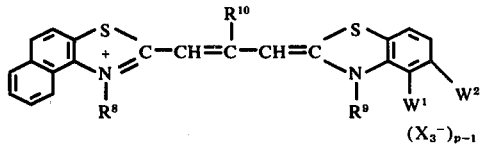

in which $R^8$ and $R^9$ each represents an alkyl group, $R^{10}$ represents an alkyl group, an aryl group, a furyl group or a thienyl group, $W^2$ represents a hydrogen atom, a halogen atom, an alkyl group, an alkoxy group, a hydroxy group, an alkoxycarbonyl group, an acyl group, an acylamino group or a phenyl group, and $W^2$ may form a benzene nucleus in conjunction with $W^1$, $W^1$ represents a hydrogen atom or an atomic group required to form a benzene nucleus in conjunction with $W^2$, $X_3$ represents an acid anion, and $p$ is 1 or 2, $p$ being 1 in the case that the dye forms an inner salt (betaine-like structure);

general formula (IV)

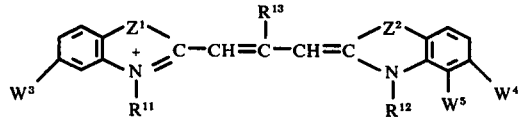

in which $Z^1$ and $Z^2$ each represents a sulfur atom or a selenium atom, $W^3$ and $W^4$ each represents a hydrogen atom, an alkyl group, an alkoxy group, a hydroxy group, a halogen atom, a phenyl group, an acyl group, an acylamino group or an alkoxycarbonyl group, $W^4$ may form a benzene nucleus in conjunction with $W^5$ only when $W^1$ and $W^2$ in general formula (III) form a benzene nucleus, $W^5$ represents a hydrogen atom or an atomic group required to form a benzene nucleus in conjunction with $W^4$, $R^{11}$ and $R^{12}$ each represents an alkyl group or a substituted alkyl group having a sulfo group, at least one of $R^{11}$ and $R^{12}$ representing a substituted alkyl group having a sulfo group, and $R^{13}$ represents alkyl group; and when the dye represented by general formula (I), (II), (III) or (IV) is an anionic dye, it has a cation as a counter ion.

2. A spectrally sensitized silver halide photographic emulsion as claimed in claim 1, wherein the dye of general formula (I), the dye of general formula (II), the dye of general formula (III) and the dye of general formula (IV) are added in a molar ratio of (1–20) : (1–20) : 1 : (4–40).

3. A spectrally sensitized silver halide photographic emulsion as claimed in claim 2, wherein in general formula (III) $R^{10}$ represents a methyl group, ethyl group or propyl group and $W^1$ and $W^2$ form a benzene nucleus.

4. A spectrally sensitized silver halide photographic emulsion as claimed in claim 2, wherein in general formula (III) $R^{10}$ represents a phenyl group and $W^1$ and $W^2$ form a benzene nucleus.

5. A spectrally sensitized silver halide photographic emulsion as claimed in claim 2, wherein in general formula (IV) $R^{13}$ represents an ethyl group, $W^3$ and $W^4$ each represents a halogen atom, an alkyl group, an alkoxy group or an acylamino group and $Z^1$ and $Z^2$ each represents a sulfur atom.

6. A spectrally sensitized silver halide photographic emulsion as claimed in claim 2, wherein in general formula (IV) $Z^1$ and $Z^2$ each represents a selenium atom and $W^3$ and $W^4$ each represents a hydrogen atom, an alkyl group or an alkoxy group.

7. A spectrally sensitized silver halide photographic emulsion as claimed in claim 2, wherein the dyes respectively represented by general formulae (I), (II), (III) and (IV) are those respectively represented by general formulae (I-1), (II-1), (III-1) and (IV-1):

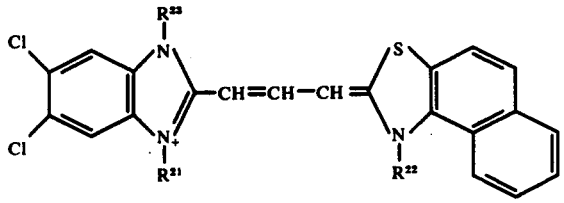

(I-1)

wherein $R^{21}$ and $R^{22}$ each represents a sulfoalkyl group and $R^{23}$ represents an alkyl group;

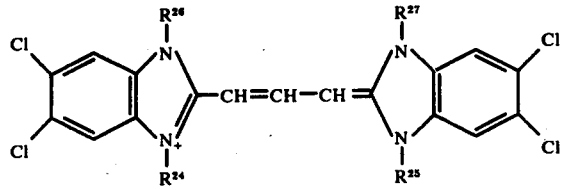

(II-1)

wherein $R^{24}$ and $R^{25}$ each represents a sulfoalkyl group or a sulfoalkoxyalkyl group and $R^{26}$ and $R^{27}$ each represents an alkyl group;

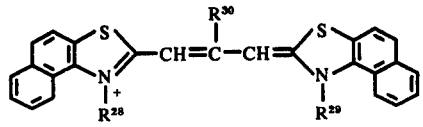

(III-1)

wherein $R^{28}$ and $R^{29}$ each represents a sulfoalkyl group and $R^{30}$ represents a methyl group or an ethyl group;

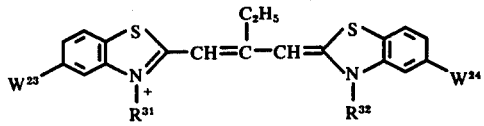

(IV-1)

wherein $W^{23}$ and $W^{24}$ each represents a hydrogen atom, a chlorine atom, an alkyl group having 1 to 4 carbon atoms, an alkoxy group having 1 to 4 carbon atoms or a hydroxy group, and $R^{31}$ and $R^{32}$ each represents a sulfoalkyl group.

8. A spectrally sensitized silver halide photographic emulsion as claimed in claim 1, wherein the dye of general formula (I), the dye of general formula (II), the dye of general formula (III) and the dye of general formula (IV) are added in a molar ratio of (1–10) : (1–10) : 1 : (6–30).

9. A spectrally sensitized silver halide photographic emulsion as claimed in claim 3, wherein the dye of general formula (I), the dye of general formula (II), the dye of general formula (III) and the dye of general formula (IV) are used in a molar ratio of 2.0–6.0 : 1.5–6.0 : 1 : 6.0–20.0.

10. A spectrally sensitized silver halide photographic emulsion as claimed in claim 4, wherein the dye of general formula (I), the dye of general formula (II), the dye of general formula (III) and the dye of general formula (IV) are used in a molar ratio of 4.0–10.0 : 3.0–10.0 : 1 : 10.0–30.0.

11. A spectrally sensitized silver halide photographic emulsion as claimed in claim 7, wherein the dye of general formula (I), the dye of general formula (II), the dye of general formula (III) and the dye of general formula (IV) are added in a molar ratio of (1–10) : (1–10) : 1 : (6–30).

12. A spectrally sensitized silver halide photographic emulsion as claimed in claim 9, wherein the dye of general formula (III) is used in an amount ranging from $0.2 \times 10^{-5}$ mol to $2.4 \times 10^{-5}$ mol per mol of silver halide.

13. A spectrally sensitized silver halide photographic emulsion as claimed in claim 10, wherein the dye of general formula (III) is used in an amount ranging from $0.05 \times 10^{-5}$ mol to $2.4 \times 10^{-5}$ mol per mol of silver halide.

* * * * *